United States Patent [19]

Nakanishi

[11] Patent Number: 4,640,649

[45] Date of Patent: Feb. 3, 1987

[54] METHOD AND APPARATUS FOR FORMING AN UNDERGROUND SOLIDIFICATION STRUCTURE

[75] Inventor: Wataru Nakanishi, Machida, Japan

[73] Assignee: N.I.T. Co., Ltd., Tokyo, Japan

[21] Appl. No.: 729,143

[22] Filed: Apr. 30, 1985

[30] Foreign Application Priority Data

May 9, 1984 [GB] United Kingdom ..... 8411774

[51] Int. Cl.[4] ..... E02D 3/10

[52] U.S. Cl. ..... 405/237; 405/248; 405/233

[58] Field of Search ..... 405/237, 248, 269, 267, 405/266; 175/65–72

[56] References Cited

U.S. PATENT DOCUMENTS

| | | | |
|---|---|---|---|
| 3,808,823 | 5/1974 | Chelminski | 405/237 X |
| 3,839,875 | 10/1974 | Matsushita | 405/248 |
| 3,969,902 | 7/1976 | Ichise et al. | 405/267 |

FOREIGN PATENT DOCUMENTS

| | | | |
|---|---|---|---|
| 26115 | 2/1983 | Japan | 405/237 |
| 150618 | 9/1983 | Japan | 405/269 |
| 256150 | 8/1926 | United Kingdom | 405/237 |

*Primary Examiner*—Dennis L. Taylor

*Attorney, Agent, or Firm*—Cushman, Darby & Cushman

[57] ABSTRACT

A method and apparatus for forming solidification structures in the underground (G) in which an insertion tube assembly (A) having a bit (12), an ultrasonic sensor (15) at the leading end thereof and an external nozzle direction monitoring device is inserted into the underground. While being rotated alternately in one and the other directions to dig a cavity in the ground, filling liquid is spouted into the cavity in the underground. The filling liquid is sucked upwardly through the insertion tube assembly together with the soil displaced by the digging of the cavity onto the ground where the liquid is separated from the soil. The filling liquid is recycled to the cavity to protect the wall of the cavity against collapsing. The filling liquid-soil suction and liquid recycling procedure is repeated until the cavity is dug to a predetermined depth. The direction of the jet nozzle (3) in the insertion tube assembly (A) at the predetermined depth of the cavity is monitored. The digging material is spouted through the jet nozzle (3) into the cavity to form the cavity (41) to a predetermined shape and solidification material is filled in the cavity (41) while monitoring the shape of the cavity 41 by the ultrasonic sensor (15) to thereby form a solidification structure in the underground.

8 Claims, 7 Drawing Figures

METHOD AND APPARATUS FOR FORMING AN UNDERGROUND SOLIDIFICATION STRUCTURE

BACKGROUND OF THE INVENTION

1. Field of the Invention

This invention relates to a method and apparatus for forming underground solidification structures such as soft ground reinforcing structures, underground cutoff walls and building foundations.

2. Description of the Related Art

In one of the prior art methods for reinforcing soft ground, a ground solidification material spouting tube was driven into the underground while imparting rotation thereto and solidification material was spouted through the tube into the underground to thereby solidify the soil and earth in the underground. However, such a prior art device had the disadvantage that, since the soil and gravel displaced from a selected area in the underground where the solidification material was spouted were mingled with the solidification material, the area could not be always reinforced with a calculated uniform strength which makes it difficult to provide an optional or desired strength to the underground area. Furthermore, since the solidification material is spouted through the jet nozzle at the leading or lower end of the spouting tube while the tube is rotating so that the operator cannot monitor which direction the nozzle is directed to, the solidification material is randomly spouted into the underground and mingles with the surrounding soil. Thus, the solidification structure to be formed in the underground was limited to a column- or sheet-like configuration. In addition, since the swivel joint through which rotational movement from an external driving device was transmitted to the spouting tube was subjected to limitation in design, spouting tubes having a plurality of liquid feed hoses such as three- and fourfold-spouting tubes could not be employed.

SUMMARY OF THE INVENTION

According to the present invention, a cavity of a predetermined shape is formed in the underground by discharging the soil displaced by digging onto the ground and a solidification structure is formed in the cavity by spouting solidification material into the cavity. Thus, since the displaced soil is perfectly replaced by the solidification material in the cavity, a solidification structure having a strength as high as 180 kg/cm$^2$ can be formed if desired and a solidification structure of any desired shape can be formed by monitoring which direction the spouting nozzle is directed to in the underground.

Furthermore, when the insertion tube assembly is rotated alternately in one and the other directions by a predetermined angle instead of being continuously rotated in one direction so as to prevent the liquid feed hoses and cord associated with the insertion tube assembly from twisting whereby insertion tube assemblies of complicated constructions, which the conventional swivel joints could not handle, can be satisfactorily operated.

The above and other objects and attendant advantages of the present invention will be more readily apparent to those skilled in the art from a reading of the following detailed description in conjunction with the accompanying drawings which show one preferred embodiment of the invention for illustration purposes only, but not for limiting the scope of the claims in any way.

DESCRIPTION OF THE PREFERRED EMBODIMENT

The present invention will be now described referring to the accompanying drawings.

Figure 1:
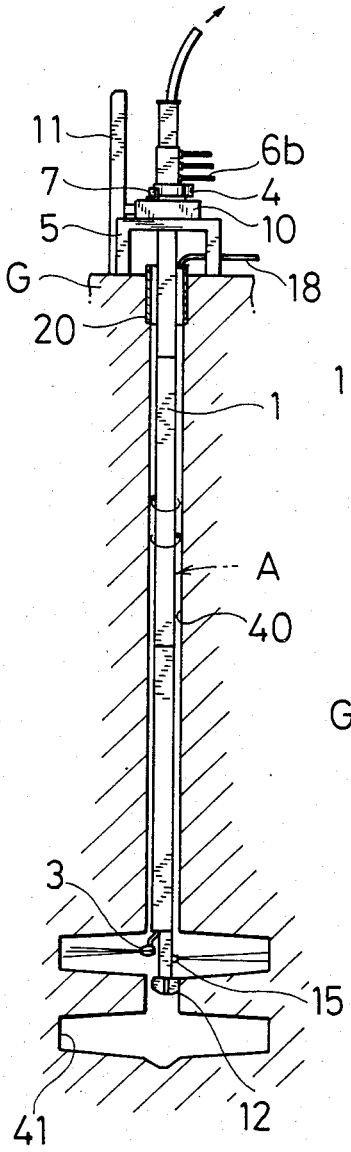
FIG. 1 is a schematic elevational view of the preferred embodiment of the apparatus for forming underground solidification structures according to the present invention with the ground equipment associated with the apparatus removed therefrom.

In FIG. 1, an insertion tube assembly A generally comprises a casing 1 forming the main tube body of the assembly. A jet spouting tube 2 (FIG. 2) extends within the casing 1 eccentric to the latter. A jet spouting nozzle 3 (FIG. 1) is provided at the lower end of the tube 2 in communication with the latter in such a manner that the direction of the jet spouting through the nozzle 3 can be positively observed on the ground by the configuration of the casing 1 itself or an indication mark on the casing 1.

Figure 4:
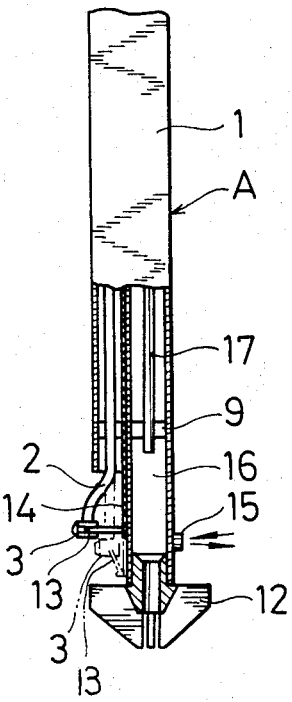
FIG. 4 is a fragmentary elevational view on an enlarged scale of the leading or lower end portion of the insertion tube assembly with a portion thereof cut away.
Figure 7:
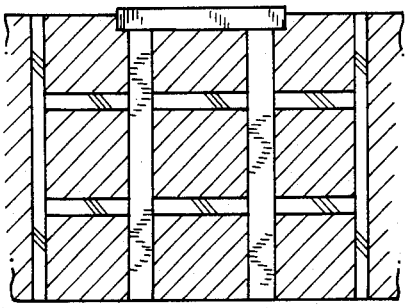
FIG. 7 is a elevational view of other underground solidification structures formed in the underground according to the present invention.

The casing 1 comprises a series of tube sections of suitable and equal length connected together by means of joint portions 8 (FIG. 2) formed on the tube sections with transverse partitions 9 interposed between the adjacent tube sections. The transverse partitions 9 are adapted to hold inner tubes of which description will be made hereinafter in position. In the illustrated embodiment, although the tube section is in the form of a trapezoid cross-section rod which reduces in dimensions in the spouting direction of the jet nozzle 3, alternatively, the tube section may be in the form of a flanged tube the flange of which is provided with an indication mark. When the angular tube section is employed, the tube section can be positively gripped by a chuck without the possibility of slippage whereby the tube section can withstand a high rotation torque and positive operation of the apparatus can be attained. A chuck 4 is associated with a supporting and rotating device 5 for the insertion tube assembly A. The chuck 4 comprises adjustable setters *6a*, *6b* provided on the periphery thereof angularly spaced from each other by an angular distance to set the insertion tube assembly in an optional position as the insertion tube assembly A is rotated by the device 5. When the angle between the setters *6a*, *6b* is set as $\alpha$, each time the chuck 4 and accordingly, the insertion tube assembly A rotates by the angle $\alpha$, a switch 7 strikes against the setter *6a* or *6b* to reverse the rotative direction of a driving device 10 for the chuck 4 whereby the insertion tube assembly A rotates continuously and alternately in one and the other directions covering the angular distance determined by the angle $\alpha$. The switch 7 is provided on and extends upwardly from the driving device 10. When either one of the setters 6a and 6b is eliminated, the insertion tube assembly A reverses its rotation direction each time the assembly has rotated by 360°. A device 11 moves the insertion tube assembly A downwardly into and upwardly out of the underground. A bit 12 (FIG. 1) is provided at the leading or lower end of the insertion tube assembly A and the bit 12 digs a cavity in the ground G as the insertion tube assembly A rotates continuously and alternately in one and the other directions. As the digging operation progresses to increase the depth of the cavity, the insertion tube assembly A gradually lowers into the underground. As shown in FIG. 4, a nozzle support bar 13 is pivoted at the base 14 thereof to the jet spouting nozzle 3 above the bit 12 for supporting the jet spouting nozzle 3 and also for slidable movement upwardly and downwardly along the insertion tube assembly A. When the base 14 of the support bar 13 is moved upwardly along the insertion tube assembly A, the leading end of the support bar 13 protrudes substantially horizontally away from the tube assembly A to thereby protrude the nozzle 3 laterally away from the insertion tube assembly A. When the jet spouting tube 2 is moved upwardly and downwardly independent of the casing 1, the nozzle 3 can be moved upwardly and downwardly independent of the nozzle support bar 13. Provided on the side of the leading end of the insertion tube assembly A opposite from the side thereof where the jet nozzle 3 is provided, there is an ultrasonic sensor 15, a reverse suction tube 16 and a solidification material spouting tube 17 open on the side of the tube assembly A where the ultrasonic sensor 15 is provided. In the illustrated embodiment, the hollow interior of the casing 1 forms the reverse suction tube 16. There is also a sensor cord 19. The reverse suction tube 16 and material spouting tube 17 may be replaced by a single common tube unit depending upon the type of the solidification material employed.

With the above-mentioned construction and arrangement of the components of the apparatus, in operation, the insertion tube assembly A is lowered into the underground G while being rotated continuously and alternately in one and the other directions with the bit 12 digging out the cavity in the underground G. As the insertion tube assembly A lowers into the cavity being dug in the underground, a vertical pipe 20 (FIG. 1) surrounding the insertion tube assembly A protects the wall of the cavity against collapsing and at the same time, bentonite liquid is pumped through a tube 18 connected at the outer end to a suitable bentonite liquid supply source (not shown) and communicates at the inner end with the tube 18 and the pipe 20 surrounding the tube assembly into the cavity. The bentonite liquid is imparted swirling movement thereto and forms sludge together with the soil displaced from the earth and soil formation surrounding the cavity by the digging to fill the cavity. The swirling bentonite liquid is sucked upwardly onto the ground above the cavity by the reverse suction tube 16 (FIG. 2) together with the displaced soil. From the sludge, there is then removed the soil component leaving the bentonite liquid which is then recycled to the cavity through the tube 18 and pipe 20. When the insertion tube assembly A has reached a predetermined depth in the underground or the cavity has been dug to the predetermined depth in the underground, a jet of digging material is spouted under high pressure through the jet spouting tube 2 and nozzle 3 into the cavity to displace the soil layer defining the cavity. In the same manner as described in connection with the spouting of bentonite liquid, the displaced soil is sucked upwardly through the reverse suction tube 16 onto the ground. When the suction tube 16 is provided with an auxiliary air tube 21, in addition to the suction action provided by the suction tube 16 itself, an air lift effect can be provided by the auxiliary air tube 21 to enhance the suction effect. Since the position of the jet spouting nozzle 3 can be varied by the manipulation of the nozzle support bar 13 as mentioned hereinabove in regard to FIG. 4, the cavity can be dug to any desired shape. The wall of the cavity 41 (FIG. 1) can be protected against collapsing under the filling pressure of the swirling bentonite liquid and the volume and shape of the cavity 41 are sensed by the ultrasonic sensor 15. The sensed volume and shape are transmitted through the sensor cord 19 (FIG. 3) to a monitor (not shown) on the ground. Alternatively, the information relating to the nature of the soil in the underground can be obtained by passing the jet along the pilot cavity wall 40 (FIG. 1) at constant speed and pressure from the jet nozzle 3. By determining the concave-convex configuration of the digging by the sensor 15, the shape of the cavity 41 can be determined based on the sensed nature of the soil.

Figure 2:
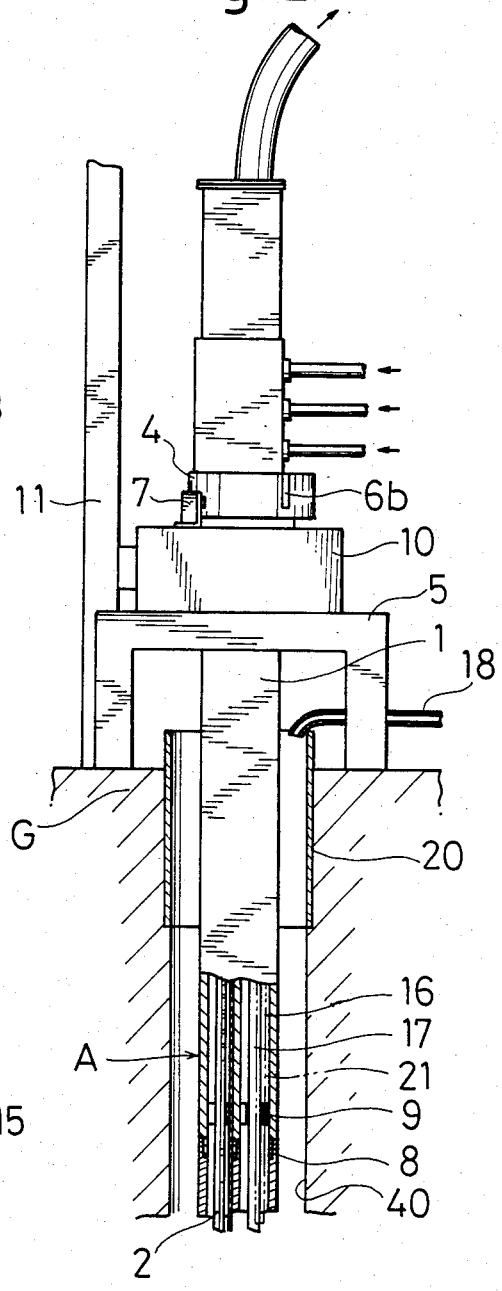
FIG. 2 is a fragmentary elevational view on an enlarged scale of the apparatus as shown in FIG. 1 with a lower portion of the insertion tube assembly cut away.
Figure 3:
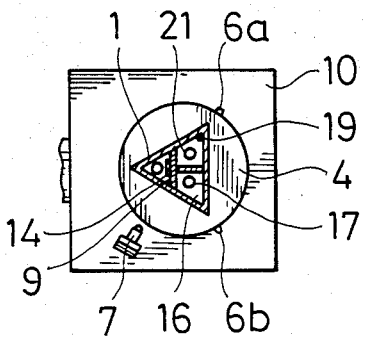
FIG. 3 is a cross-sectional view showing the relationship between the setter means and switch.
Figure 6:
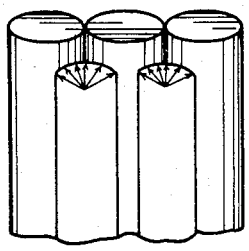
FIG. 6 is a perspective view of underground solidification structures formed in the underground according to the present invention.
Figure 5:
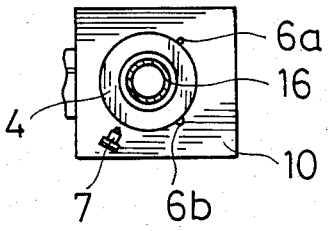
FIG. 5 is similar to FIG. 3, but shows a modified insertion tube assembly.

After the cavity 41 has been formed to a predetermined shape, solidification material is spouted through the solidification material spouting tube 17 (FIG. 2) into the cavity to fill the cavity 41 (FIG. 2). When the jet of digging material is not spouted through the jet nozzle 3 when the solidification material is spouted, the jet nozzle 3 or the reverse suction tube 16 (FIG. 2) may be utilized as the solidification material spouting tube 17 depending upon the type of the solidification material.

The solidification material may be selected from the group comprising cement, sodium silicate, acrylic amide, asphalt, urethane resin and isocyanate depending upon a specific solidification structure to be formed. By repeating the above procedure, successive solidification structures are formed on the procedure can be also applied to a specific area to be reinforced.

With the above-mentioned construction and arrangement of the apparatus of the present invention, the following effects can be attained.

Since the insertion tube assembly A rotates continuously and alternately in one and the other directions, but not continuously in one direction only, an excellent mechanism arrangement is realized whereby the monitor on the ground, the sensor 15 in the underground, the mechanism at the leading end of the insertion tube assembly, the operation means on the ground and the material supply means can be satisfactorily interrelated to each other by relatively simple means without being intermittently disturbed as the insertion tube assembly A rotates as experienced in the prior arts.

Furthermore, since the rotation angle of the insertion tube assembly A can be optionally set by the cooperating switch 7 (FIG. 3) and adjustable setters 6a, 6b, a sector-shaped solidification structure can be formed within a predetermined angular range and the solidification structure can be concentratively formed at a precisely defined area.

Furthermore, since the solidification structure is formed by perfectly replacing the displaced soil by the filling material by means of the swirling liquid, solidification structures of high strength can be obtained instead by the conventional pile-driving procedure.

The nozzle can define solidification structures to an optional or desired shape.

While only one embodiment of the invention has been shown and described in detail, it will be understood that this embodiment is for illustration purposes only and not to be taken as a definition of the invention, reference being had for this purpose to the appended claims.

What is claimed is:

1. A method for forming an underground solidification structure comprising the steps of inserting an insertion tube assembly including a reverse suction tube, a high pressure jet spouting tube and a solidification material spouting tube to a predetermined depth into an area of the underground where a solidification structure is to be formed, filling a cavity formed in said underground area by the insertion of said insertion tube assembly therein with bentonite liquid or the like, recycling said bentonite between said cavity and an external device, spouting digging material as a high pressure jet laterally through said high pressure jet spouting tube against the wall of said cavity to dig down the cavity while rotating the tube assembly continuously and alternately in one and the other directions covering a predetermined angular distance, sucking the soil displaced from the wall of said cavity upwardly through said reverse suction tube onto the ground with the soil entrained in the bentonite liquid and at the same time monitoring the conditions of said dug cavity by a monitor on said insertion tube assembly and spouting solidification material through said solidification material spouting tube into said cavity to thereby reinforce the underground.

2. The method as set forth in claim 1, in which said solidification material is spouted through a downwardly directed spouting tube after the digging operation by said jet spouting has completed.

3. The method as set forth in claim 1, in which said solidification material is spouted laterally of said tube assembly as a high pressure jet.

4. The method as set forth in claim 1, in which after said digging of a pilot cavity by a bit at the leading end of said insertion tube assembly has completed, said insertion tube assembly is moved along the wall of said pilot cavity at a constant speed while spouting digging material laterally of the tube assembly and the conditions of said pilot cavity are sensed by an ultrasonic sensor at the leading end of said insertion tube assembly whereby an insertion tube assembly operator determines the distribution conditions of the nature of the soil at a particular area of the underground.

5. An apparatus for forming a solidification structure underground comprising:

an insertion tube assembly including a a nozzle at a leading end thereof with a spouting opening for reverse suction and for jet spouting of solidification material underground, said insertion tube assembly further including a bit and an ultrasonic sensor at the leading end thereof underground and monitoring means at a trailing end thereof above ground;

a rotary chuck being connected above ground to the trailing end of the insertion tube assembly and having setter means adapted to reverse the rotation direction of said insertion tube assembly each time a switch abuts against said setter means; and means for moving said insertion tube assembly upwardly and downwardly underground, said moving means being connected above ground to the rotary chuck.

6. The apparatus as set forth in claim 5, in which said setter means comprises two adjustable setters provided on the periphery of said rotary chuck.

7. The apparatus as set forth in claim 5, in which said nozzle is supported by an underlying bar pivoted at a base end to said insertion tube assembly and at the leading end to opposite sides of the nozzle whereby, when the base end supported slidably along the insertion tube assembly is moved upwardly, the nozzle is protruded laterally from the insertion tube assembly in a spouting direction.

8. The apparatus as set forth in claim 7, in which said nozzle is moved upwardly and downwardly by an operator above ground by simultaneously moving said spouting opening and the base end of said supporting bar upwardly and downwardly.

* * * * *